US008661577B2

(12) United States Patent
Cusimano

(10) Patent No.: US 8,661,577 B2
(45) Date of Patent: Mar. 4, 2014

(54) UNDERMOUNT SINK, MOUNTING STRUCTURE, AND METHOD OF ATTACHMENT

(76) Inventor: Chad Michael Cusimano, Rochester, NY (US)

( * ) Notice: Subject to any disclaimer, the term of this patent is extended or adjusted under 35 U.S.C. 154(b) by 1267 days.

(21) Appl. No.: 11/953,047

(22) Filed: Dec. 8, 2007

(65) Prior Publication Data

US 2009/0144893 A1 Jun. 11, 2009

(51) Int. Cl.
*E03C 1/33* (2006.01)
*E03C 1/182* (2006.01)
*A47K 1/05* (2006.01)

(52) U.S. Cl.
USPC ..... 4/632; 4/633; 4/634; 4/635; 4/637; 4/643

(58) Field of Classification Search
USPC ..... 4/643, 633, 634, 619, 635, 637, 631, 4/632; 156/293, 92, 305, 91, 256, 71, 156/145, 242; 264/259
See application file for complete search history.

(56) References Cited

U.S. PATENT DOCUMENTS

| | | | | |
|---|---|---|---|---|
| 2,819,915 | A * | 1/1958 | Woodson | 241/46.015 |
| 2,876,460 | A * | 3/1959 | Harnish | 4/631 |
| 3,011,849 | A * | 12/1961 | Bishop, Jr. | 312/140.4 |
| 3,071,780 | A * | 1/1963 | Lyon, Jr. | 4/633 |
| 4,374,695 | A * | 2/1983 | Ikeda et al. | 156/293 |
| 4,432,106 | A * | 2/1984 | Smith | 4/633 |
| 4,547,951 | A * | 10/1985 | van der Kooij | 29/450 |
| 5,330,262 | A | 7/1994 | Peters | |
| 5,653,550 | A * | 8/1997 | Mutz et al. | 403/329 |
| 5,743,501 | A * | 4/1998 | Rapp | 248/201 |
| 5,860,172 | A * | 1/1999 | Pfeiffer | 4/631 |
| 5,903,936 | A * | 5/1999 | Kato | 4/633 |
| 6,108,831 | A * | 8/2000 | Lombreglia, Jr. | 4/631 |
| 6,267,136 | B1 * | 7/2001 | Johnson | 137/356 |
| 6,530,097 | B1 | 3/2003 | Sung | |
| 6,782,593 | B1 * | 8/2004 | Shimony | 29/401.1 |
| 7,007,317 | B1 | 3/2006 | Brown | |
| 7,523,511 | B2 * | 4/2009 | Marr et al. | 4/633 |
| 2006/0048295 | A1 | 3/2006 | Aldrich | |
| 2006/0253974 | A1 * | 11/2006 | Schneider et al. | 4/633 |

FOREIGN PATENT DOCUMENTS

| | | | | |
|---|---|---|---|---|
| EP | 442189 | A1 * | 8/1991 | E03C 1/33 |
| GB | 2242626 | A * | 10/1991 | E03C 1/33 |

OTHER PUBLICATIONS

Karran(R) Undermount Sinks Product Brochure. Author Unknown. 4 pages.
Karran(R) Under Mounting to Laminate Installation Guide. Author Unknown. 8 pages.
Lansen Stainless Steel Sinks Product Brochure. Author Unknown. 4 pages.
2 pages from website www.counter-seal.com dated Jan. 5, 2008.
PCT International Search Report and Written Opinion for International Application No. PCT/US 08/85778; Date of Mailing Jan. 26, 2009. 10 pages.

* cited by examiner

*Primary Examiner* — Jason J Boeckmann
*Assistant Examiner* — Steven M Cernoch
(74) *Attorney, Agent, or Firm* — Robert D. Gunderman, Jr.; Patent Technologies, LLC

(57) ABSTRACT

An undermount sink that can be integrally mounted to a laminate or solid surface countertop. The undermount sink has a novel mounting structure to accomplish mounting to a laminate countertop. A mounting flange is attached to an outer perimeter of the undermount sink bowl, and is reinforced by way of a mounting flange support within the mounting flange that is mechanically fastened to the upper outer perimeter of the undermount sink bowl.

21 Claims, 15 Drawing Sheets

UNDERMOUNT SINK, MOUNTING STRUCTURE, AND METHOD OF ATTACHMENT

BACKGROUND OF THE INVENTION

1. Field of the Invention

This invention relates generally to sinks, and more particularly to an undermount sink and related mounting structure.

2. Description of Related Art

The related art has disclosed various sinks that are mounted to a countertop using differing techniques. Sinks are fabricated in synthetic resin materials, porcelain, glass, stone, stainless steel and other metals. It is common to fabricate a rim on the perimeter of a sink that retains the sink in a cut opening in a countertop. Such a rim, while functional, lacks aesthetic qualities. In addition, the rim may retain moisture, cooking and cleaning debris, and other undesirable materials. The rim also makes it difficult to sponge or otherwise move cooking debris from the countertop surface into the sink.

The use of undermount sinks that lack such a rim, where the sink is mounted under a cut opening using specialized fasteners, has become desirable for both aesthetic and practical reasons. The term undermount sink, as used herein, refers to the lack of a visible rim on a sink as it appears on the top surface of a countertop. Undermount sinks are used in solid surface countertops such as granite, marble, soapstone, slate, concrete, and manmade products such as Corian™. It is common for fasteners to be adhered with epoxy or otherwise bonded to the underside of a solid surface countertop, allowing for mechanical retention of a sink under the solid surface countertop. Often times a bead of adhesive caulk is applied on the sink rim before the sink is coupled to the solid surface countertop to ensure proper mechanical coupling of the sink to the countertop. The attachment techniques used to fasten an undermount sink to the underside of a solid surface countertop provide an exposed edge of solid surface material within the sink opening of the countertop. This provides a certain look that many find desirable and also provides for various functional benefits, such as cleanliness and ease of cleanup.

Unfortunately, the mounting techniques used for solid surface countertops are entirely inoperable with laminate countertops. A laminate countertop often has a substrate of pressed particle board or plywood with a thin sheet of laminate material glued to the substrate. Such an arrangement does not lend itself to the undermount sink mounting techniques that are commonly used for solid surface countertops. An exposed edge of substrate material such as pressed particle board or plywood within the sink opening would not only be aesthetically undesirable, it would also not be serviceable as the substrate would quickly absorb water and damage the countertop structure.

There has therefore been an unmet need to provide an undermount sink that is functional with both solid surface countertop materials and laminate countertops. There have been several attempts in the past to mount an undermount sink to a laminate countertop. Each of these past mounting techniques exhibit functional and or aesthetic limitations, and have achieved limited commercial success. For example, Counter-Seal® of British Columbia, Canada, on their website www.counter-seal.com describes the use of a ring to seal off the exposed substrate of the laminate countertop in an undermount sink application. Such rings are not only aesthetically undesirable, they also are not integral to the counter surface and are prone to water penetration that can quickly damage or destroy the laminate countertop structure. Other attempts to mount an undermount sink to a laminate countertop have included the undermount sinks of Karran USA in Vincennes, Ind. Karran, in their product literature, describes a high density acrylic sink that is adhered to the laminate using a seam adhesive or a fiberglass resin, and then reinforced with wooden strips. This approach is limited to the use of a specialized high density acrylic sink.

Nowhere in the related art is there shown or suggested a stainless steel sink that can be integrally undermounted to a laminate countertop, and whose mounting structure is easily adaptable to other countertop materials and sink types.

It is an object of the present invention to provide an undermount sink that can be integrally mounted to a laminate countertop. It is another object of the present invention to provide an undermount sink that can be integrally mounted to a solid surface countertop. It is another object of the present invention to provide a stainless steel undermount sink that can be integrally mounted to a laminate countertop. It is yet another object of the present invention to provide a stainless steel undermount sink that can be integrally mounted to a solid surface countertop. It is yet another object of the present invention to provide a method of installing the undermount sink of the present invention and the various embodiments thereof.

BRIEF SUMMARY OF THE INVENTION

In accordance with the present invention, there is provided an undermount sink for undermounting to a laminate or solid surface countertop, the undermount sink comprising an undermount sink bowl, a mounting flange attached to the upper outer perimeter of the undermount sink bowl, and a mounting flange support within the mounting flange that is mechanically fastened to the upper outer perimeter of the undermount sink bowl.

The foregoing paragraph has been provided by way of introduction, and is not intended to limit the scope of the following claims.

BRIEF DESCRIPTION OF THE DRAWINGS

The invention will be described by reference to the following drawings, in which like numerals refer to like elements, and in which.

Figure 1:
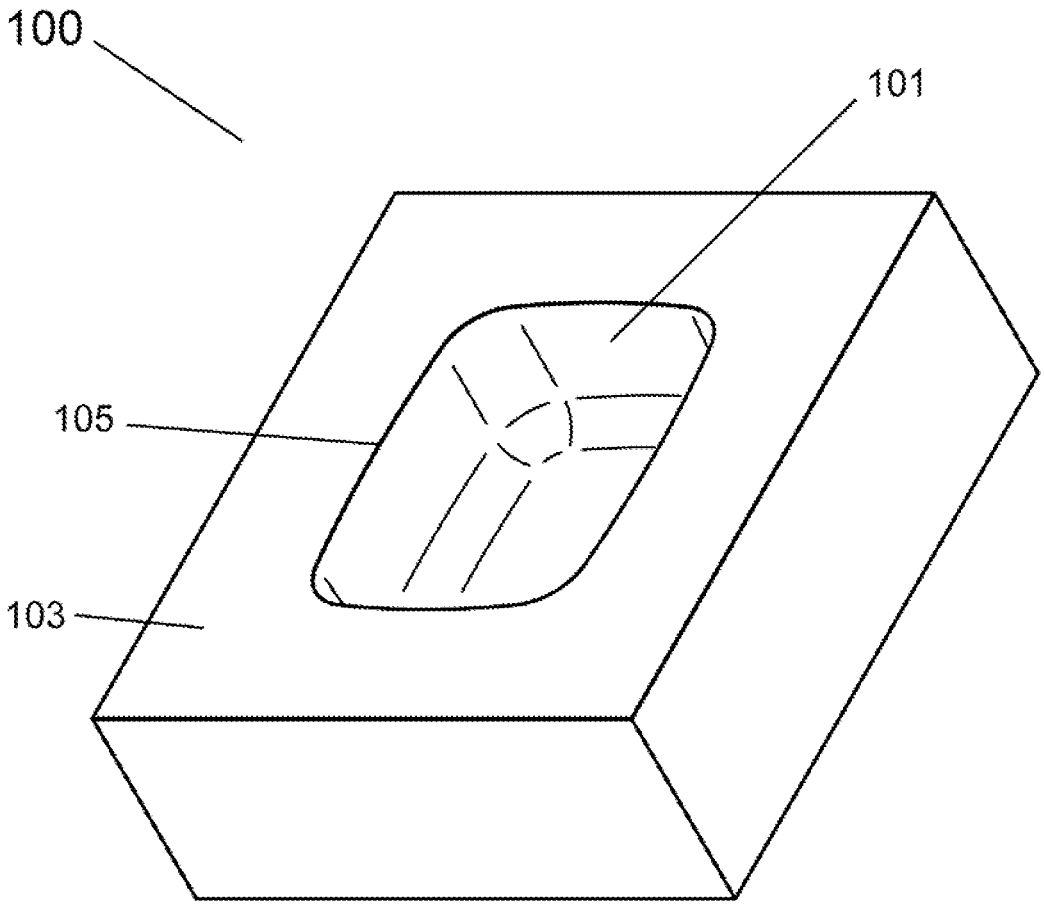
FIG. 1 is a perspective view of the undermount sink.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, drawings, and appended claims.

DESCRIPTION OF THE PREFERRED EMBODIMENTS

For a general understanding of the present invention, reference is made to the drawings. In the drawings, like reference numerals have been used throughout to designate identical elements.

FIG. 1 is a perspective view of the undermount sink showing an undermount sink installation of the present invention 100. FIG. 1 shows a sink bowl 101 that is attached to a countertop 103 without the need for any supporting structures on the top surface of the countertop 103. The sink bowl 101 may be made from a material such as stainless steel, copper, porcelain coated iron, glass, ceramic, or any of the various manmade (synthetic) materials such as fiberglass, composite stone and resin, Corian® by Dupont®, and the like. The countertop 103 shown in FIG. 1 may be a laminate countertop, a natural stone countertop, a fiberglass countertop, a butcher block countertop, a Corian® or other synthetic material countertop, and the like. Of particular note in FIG. 1, and as will be shown in greater detail in subsequent drawings, is the sink to countertop edge 105. Some of the desirable characteristics of the undermount sink of the present invention include the clean aesthetic lines of the sink to countertop edge, the lack of a top edge surface typically required to support a sink in a countertop, and the integral composition of the undermount sink to the countertop.

Figure 2:
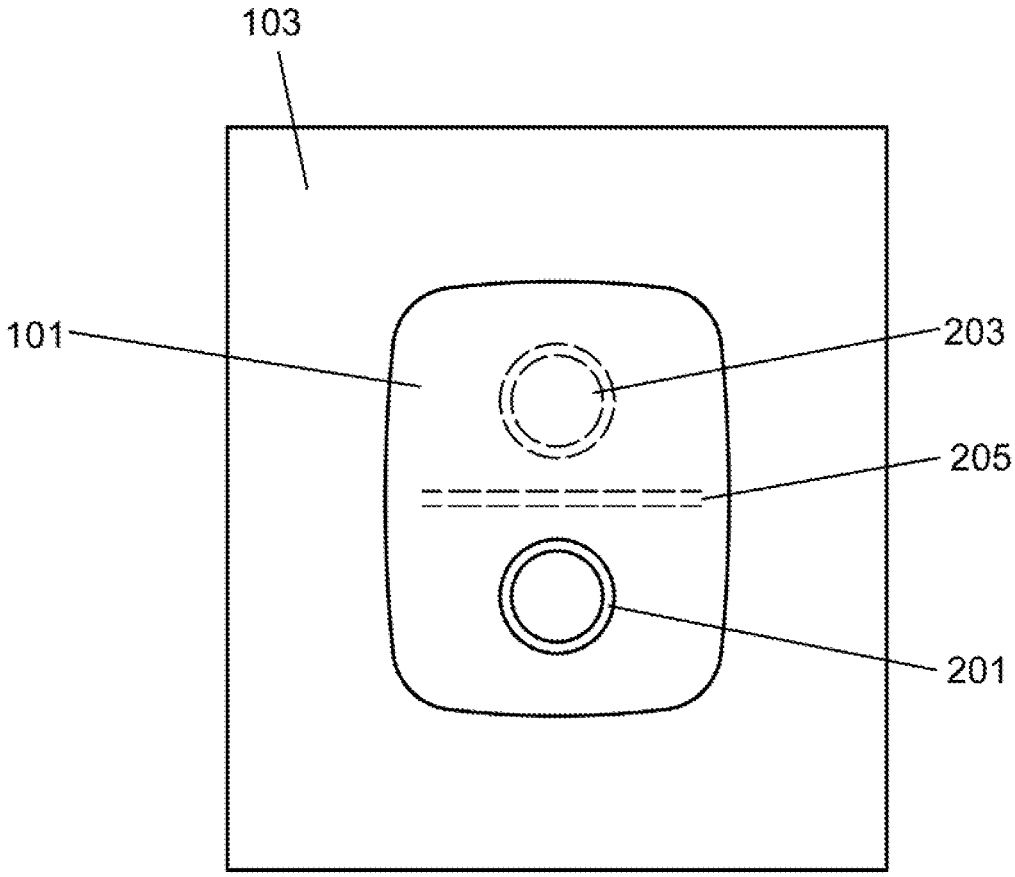
FIG. 2 is a top plan view of the undermount sink showing an optional partition and second drain as a dotted line.

FIG. 2 is a top plan view of the undermount sink showing an optional partition and second drain as a dotted line. The undermount sink in FIG. 2 has a sink bowl 101 and a drain hole 201. Also shown as dashed lines is an optional second drain hole 203, as well as an optional partition 205. The addition of further drain holes and partitions, as well as varying sizes and shapes of sink bowls, partitions and drains, including complimentary features such as soap holders, faucet holes, and other related features, are considered within the scope of the present invention and its various embodiments.

Figure 3:
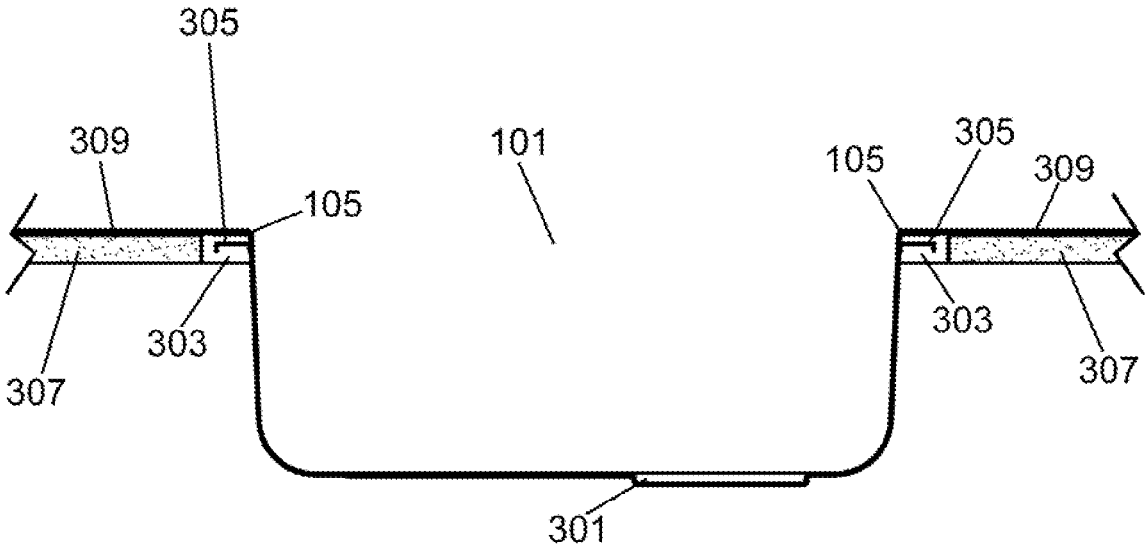
FIG. 3 is a lengthwise cutaway side view of the undermount sink installed in a laminate countertop.

To show the mounting structure of the undermount sink, FIG. 3 depicts a lengthwise cutaway side view of the undermount sink installed in a laminate countertop. FIG. 3 shows the sink bowl 101 and a drain pipe fitting 301. The sink to countertop edge 105 can be clearly seen, and will be illustrated in further detail in subsequent drawings. The mounting structure that provides for the retention of the sink bowl 101 and associated components to the countertop is also shown. The mounting structure has a mounting flange 303 and a mounting flange support 305. The mounting flange support 305 is made from a metal such as, for example, stainless steel, and traverses the perimeter of the sink bowl 101. The mounting flange support 305 is mechanically attached to the sink bowl 101 using techniques such as spot welding, pressing, casting, forming, or other techniques known to those skilled in the art. The mounting flange support 305 is shown clearly without the mounting flange 303 in subsequent FIG. 7. The mounting flange support 305 may have a bent edge, as shown in FIG. 3, or it may have other geometries that serve to strengthen the mounting flange 303. The mounting flange support 305 may also have, in some embodiments of the present invention, holes or other perforations that allow for structural bonding of the mounting flange 303 to the mounting flange support 305. The mounting flange 303 is cast from a material such as, for example, acrylic resin, fiberglass resin, or the like. In manufacturing, a form is placed circumferentially around the mounting flange support 305 after the mounting flange support 305 has been mechanically attached to the sink bowl 101. The form is subsequently filled with a resin, allowed to harden, and then the form is removed. The mounting flange 303 will also, during installation, be bonded to laminate 309; so it is advantageous if the selection of casting material for the fabrication of the mounting flange 303 be of a material that provides adequate bonding properties for use with adhesives commonly used in the construction of laminate countertops, such as, for example, an acrylic adhesive. The mounting flange support 305 is surrounded by the mounting flange 303 to provide the overall structural profile necessary to facilitate installation of the undermount sink into the countertop. As one can see from FIG. 3 and subsequent figures, the substrate 307, which may be a particle board, plywood, or other material suitable for the construction of laminate countertops, is cutout with an opening sufficient to accommodate the undermount sink. The undermount sink, during assembly, is often times placed upside down in the sink cutout in the substrate 307. The substrate 307 is, during assembly, itself placed on a solid surface. The laminate 309 is then adhered to the substrate 307 using an adhesive such as contact cement. Weights or pressure are often added to the substrate, laminate, and mounting flange assembly to ensure proper bonding of the substrate to the laminate. The laminate is then trimmed to the desired profile and a clean sink to countertop edge 105 is fabricated using a router, sander, or other such finishing tool. In some embodiments of the present invention, mechanical fasteners may be added to further retain the mounting flange to the substrate. Often times the adhesive used to bond the laminate 309 to the mounting flange 303 may be colored or tinted to match the color of the laminate or sink. In some embodiments of the present invention, a scent or odor may be added to the adhesive. The laminate 309 may be a plastic laminate such as Formica®, manufactured by the Formica Corporation in Cincinnati, Ohio, or other High Pressure Decorative Laminates (HPDL). Laminates may include metals, plastics, fabrics, paper, and the like. Formica®, for example, is a brand of composite materials manufactured by the Formica Corporation based in Cincinnati, Ohio. Formica® is a heat resistant, wipe-clean, plastic laminate of paper or fabric with melamine resin.

Figure 4:
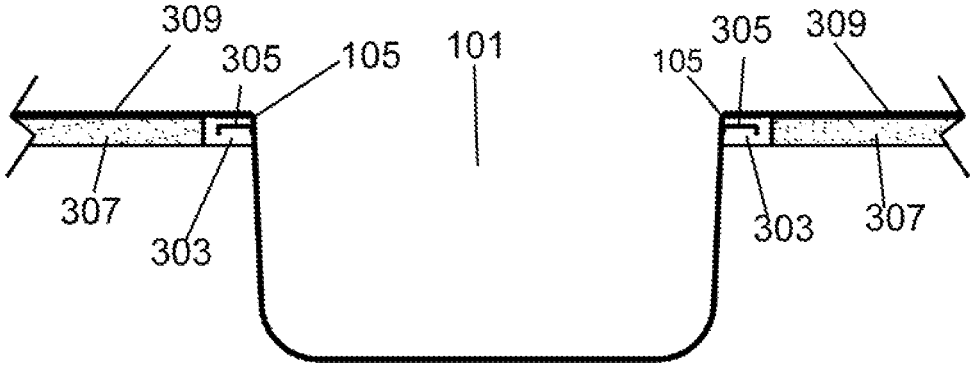
FIG. 4 is a widthwise cutaway side view of the undermount sink installed in a laminate countertop.

In a similar manner to FIG. 3, FIG. 4 shows a widthwise cutaway side view of the undermount sink installed in a laminate countertop.

Figure 5:
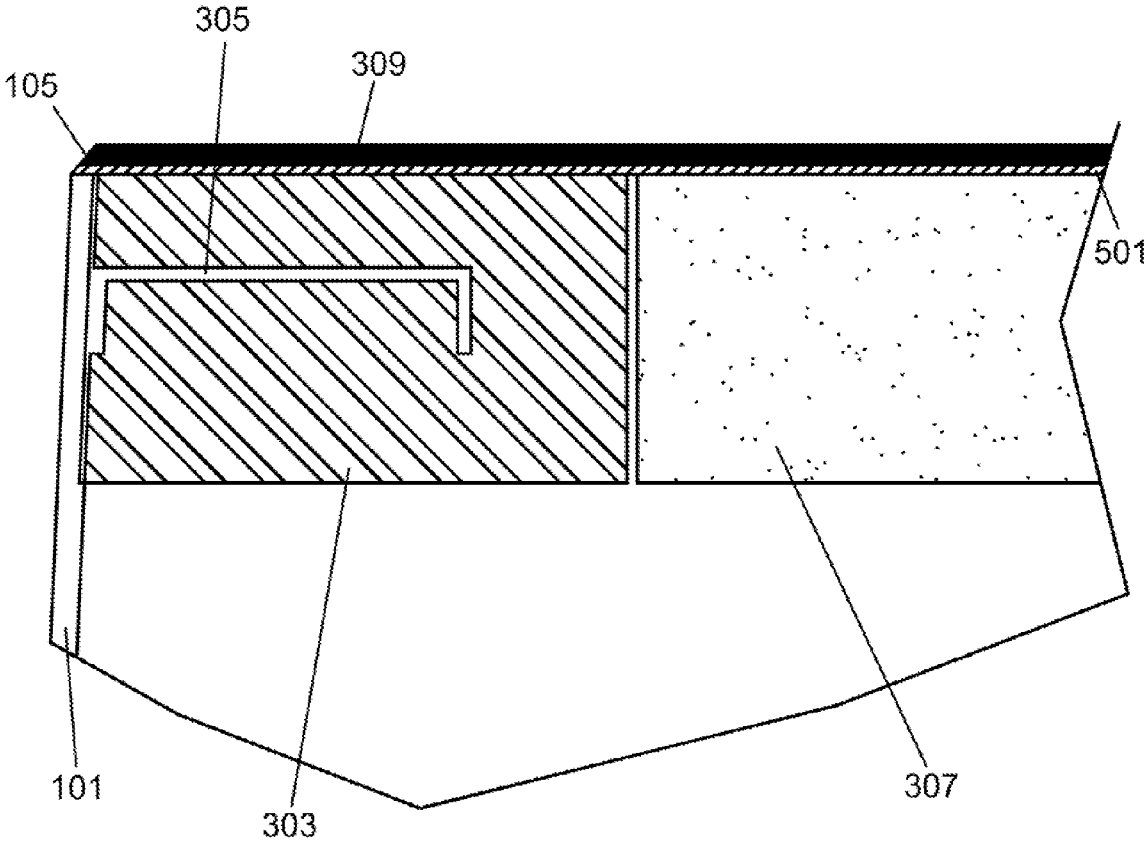
FIG. 5 is a close up sectional view of the mounting flange installed in a laminate countertop.

FIG. 5 shows a close up sectional view of the mounting flange installed in a laminate countertop. As can be clearly seen in FIG. 5, the sink bowl 101 can be seen in section, with the mounting flange support 305 attached to the sink bowl. The mounting flange 303 is cast around the mounting flange support 305. Abutting the mounting flange 303 is a substrate 307 that primarily provides structural support and integrity to a laminate countertop. In some embodiments of the present invention, a small air gap between the mounting flange 303 and the substrate 307 is present, allowing for thermal and mechanical changes to the overall structure without detrimental effects. An adhesive layer 501 is shown that bonds the laminate 309 to the substrate 307 and the mounting flange 303. The adhesive used to bond the mounting flange 303 to the laminate 309 may be a different adhesive than IS that used to bond the substrate 307 to the laminate 309. In some embodiments of the present invention, the adhesive 501 contains a tint or colorant to provide for cosmetic enhancement at the sink to countertop edge 105.

Figure 6:
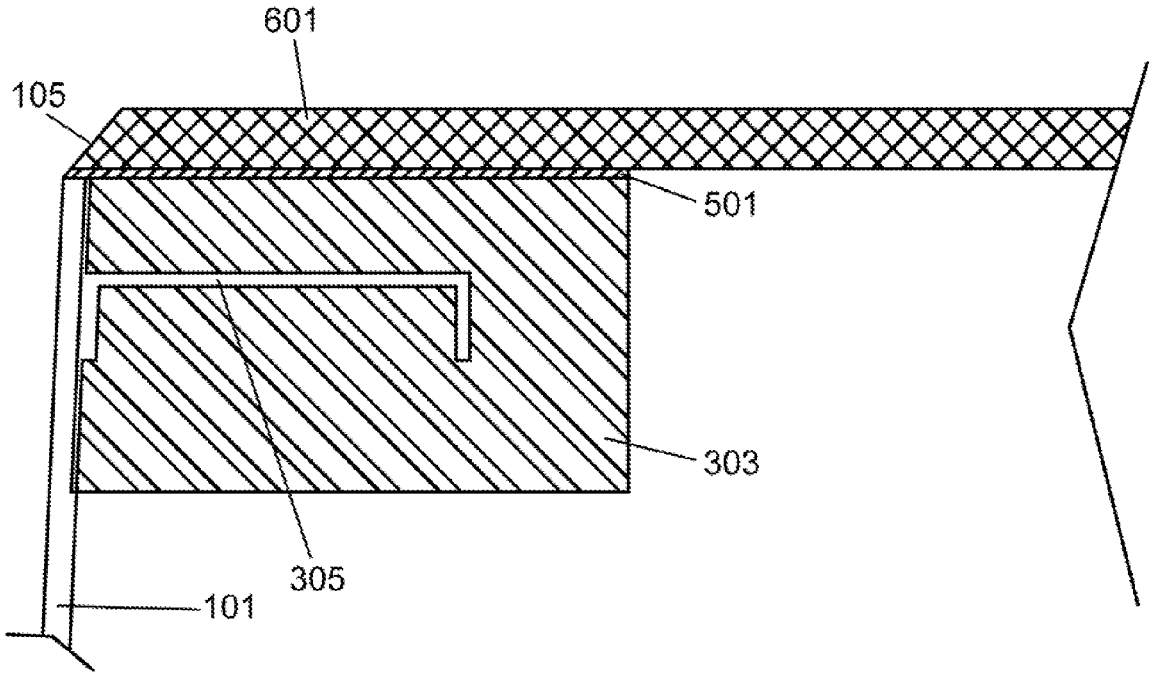
FIG. 6 is a close up sectional view of the mounting flange installed in a solid surface countertop.

In addition to laminate countertops, the undermount sink of the present invention also performs well with a solid surface countertop such as granite, marble, soapstone, butcher block, Corian® by Dupont®, fiberglass, glass, concrete, and the like. FIG. 6 shows a close up sectional view of the mounting flange installed in a solid surface countertop. Attached to the sink bowl 101 is a mounting flange support 305 that is surrounded by the mounting flange 303. The structure is similar to that described by way of FIG. 5. A solid surface countertop 601 does not, however, require a substrate and associated laminate surface. In FIG. 6, the solid surface countertop 601 provides structural integrity to the countertop itself The solid surface countertop 601 is bonded to the mounting flange 303 using an adhesive layer 501. In some embodiments of the present invention, the adhesive 501 contains a tint or colorant to provide for cosmetic enhancement at the sink to countertop edge 105.

Figure 7:
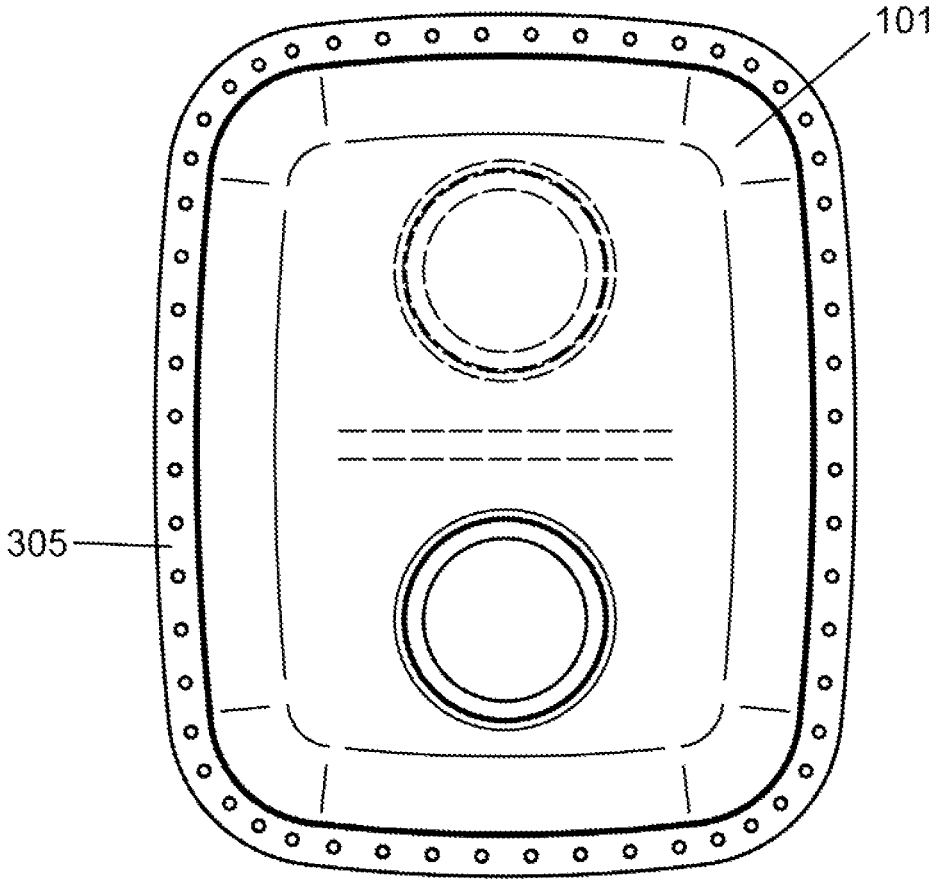
FIG. 7 is a top plan view of the undermount sink with the mounting flange removed to show the mounting flange support.

FIG. 7 shows a top plan view of the undermount sink with the mounting flange removed to show the mounting flange support 305. As can be seen from FIG. 7, the mounting flange support 305 is circumferentially attached to the sink bowl 101. The mounting flange support 305 also contains holes or other perforations to facilitate proper bonding of the mounting flange support 305 to the mounting flange (not shown in FIG. 7 for clarity and descriptive reasons only). Various adaptations to the mounting flange support 305 shown in FIG. 7 may be made without departing from the spirit and broad scope of the present invention and the various embodiments described herein.

Figure 8:
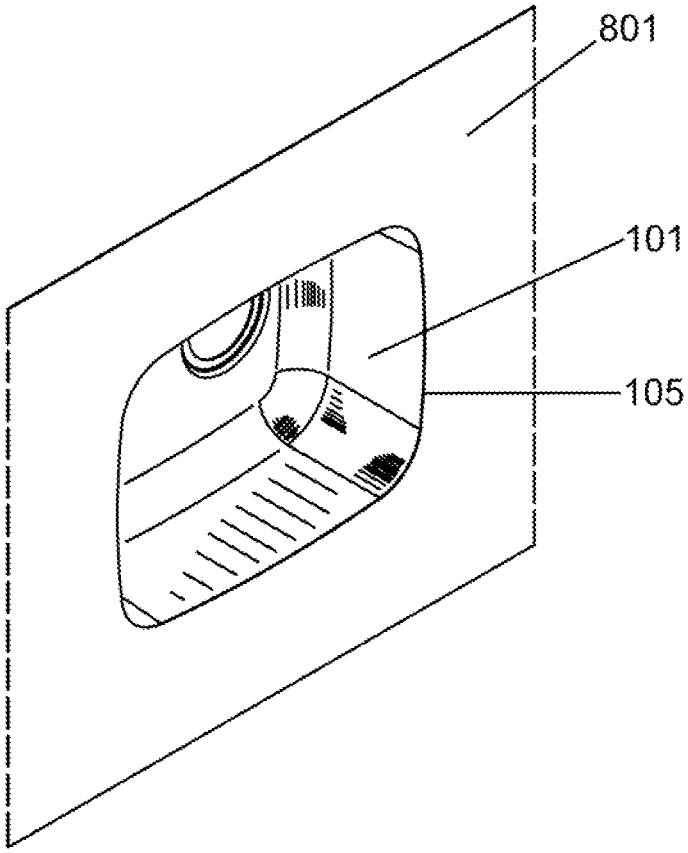
FIG. 8 is a top left front perspective view of a first embodiment of the undermount sink.

FIG. 8 shows a top left front perspective view of a first embodiment of the undermount sink of the present invention. The countertop 801 contains an undermount sink with a sink bowl. FIG. 8 also shows the sink to countertop edge 105.

Figure 9:
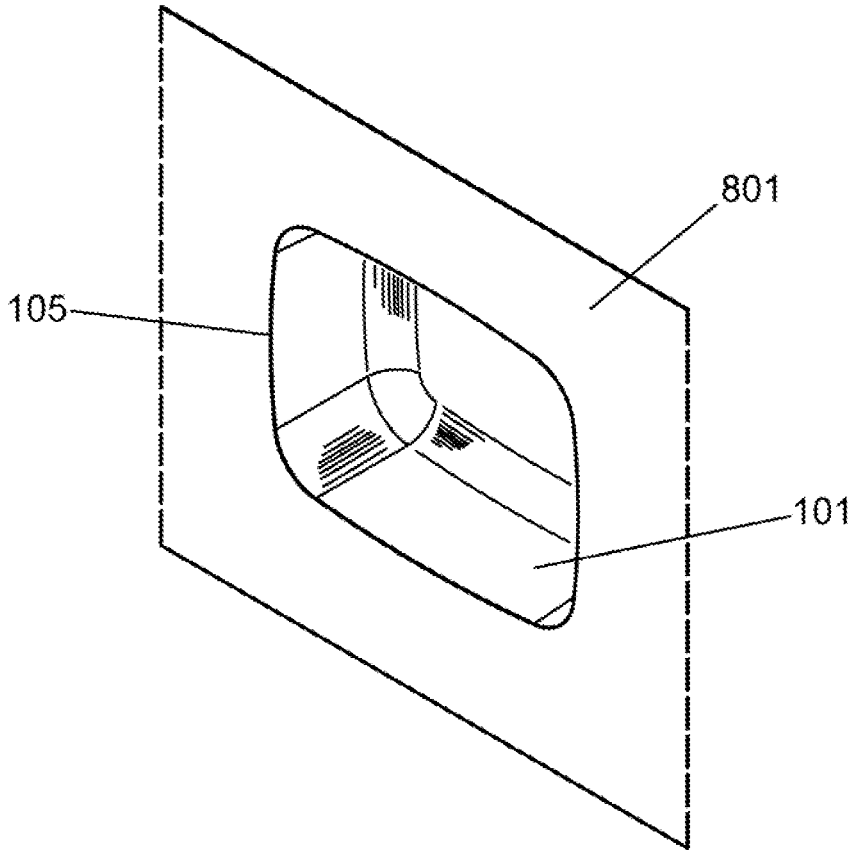
FIG. 9 is a top right front perspective view of a first embodiment of the undermount sink.
Figure 10:
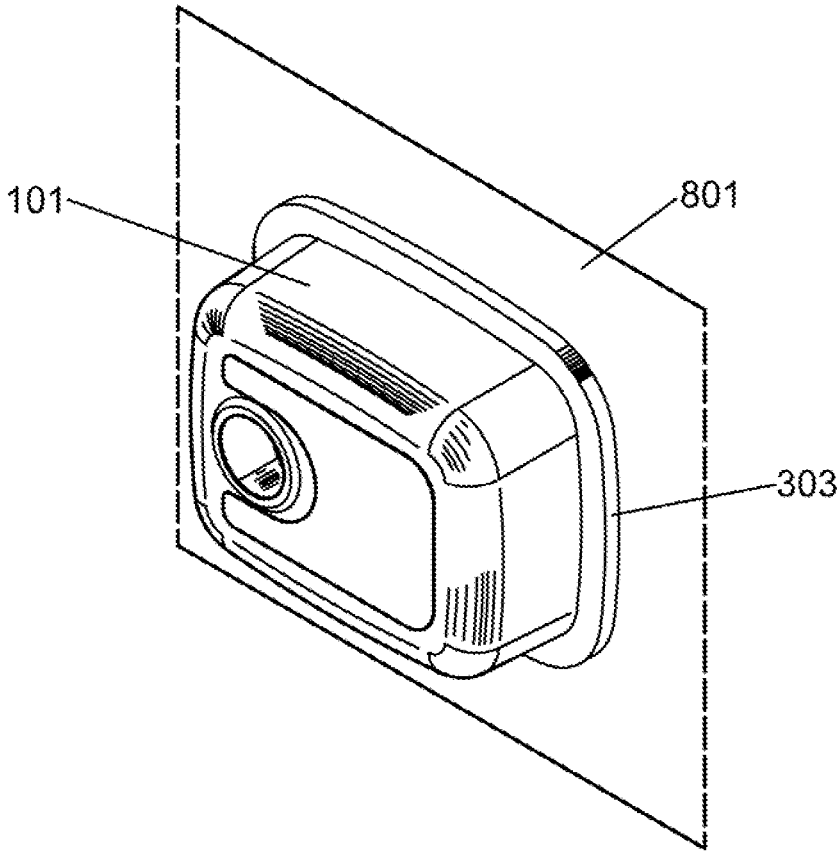
FIG. 10 is a bottom left rear perspective view of a first embodiment of the undermount sink.
Figure 11:
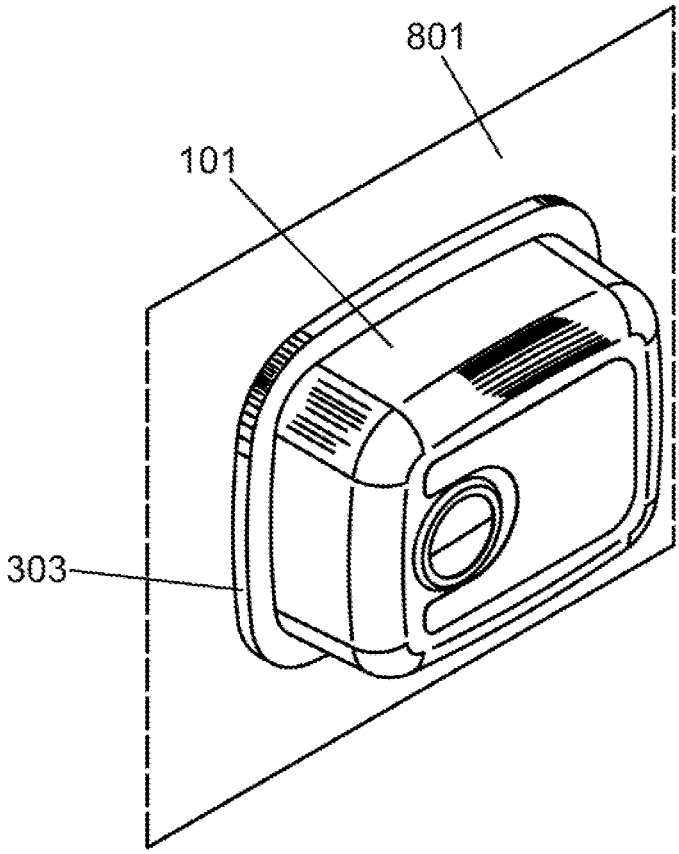
FIG. 11 is a bottom right rear perspective view of a first embodiment of the undermount sink.
Figure 12:
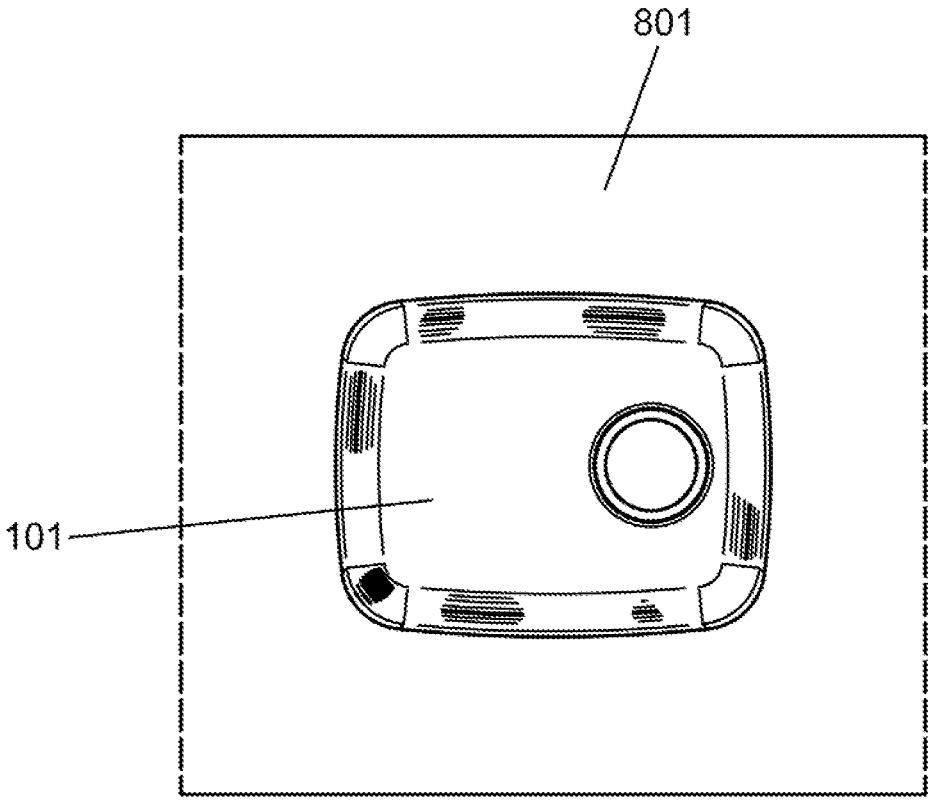
FIG. 12 is a top plan view of a first embodiment of the undermount sink.
Figure 13:
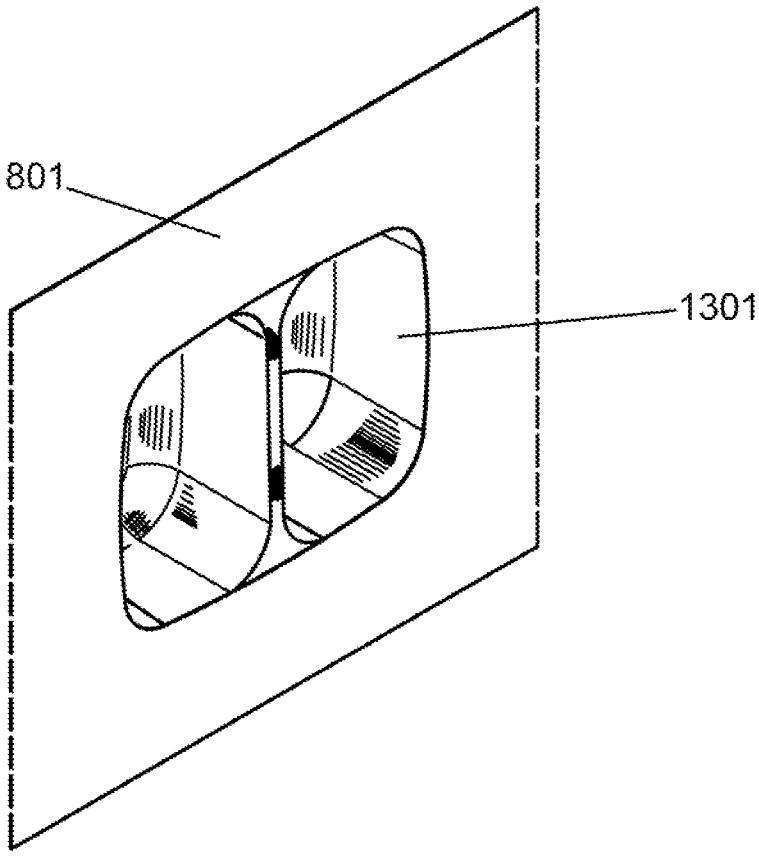
FIG. 13 is a top perspective view of a second embodiment of the undermount sink, the only difference being the addition of a partition.
Figure 14:
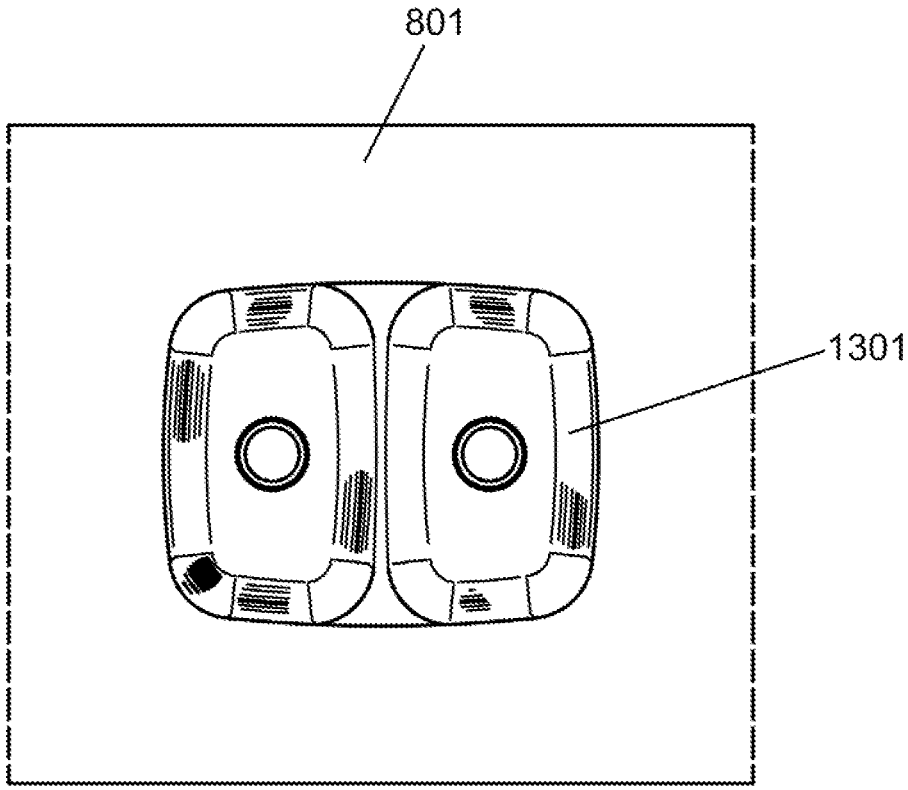
FIG. 14 is a top plan view of the second embodiment shown in FIG. 13.

FIG. 9 is a top right front perspective view of a first embodiment of the undermount sink of the present invention. FIG. 10 is a bottom left rear perspective view of a first embodiment of the undermount sink of the present invention. FIG. 11 is a bottom right rear perspective view of a first embodiment of the undermount sink of the present invention. FIG. 12 is a top plan view of a first embodiment of the undermount sink of the present invention. FIG. 13 is a top perspective view of a second embodiment of the undermount sink showing the addition of a partition. FIG. 14 is a top plan view of the second embodiment shown in FIG. 13. FIGS. 9-14 depict both a single bowl and a double bowl embodiment of the undermount sink of the present invention. Other bowl configurations, sizes, shapes and geometries fall within the spirit and broad scope of the present invention.

Figure 15:
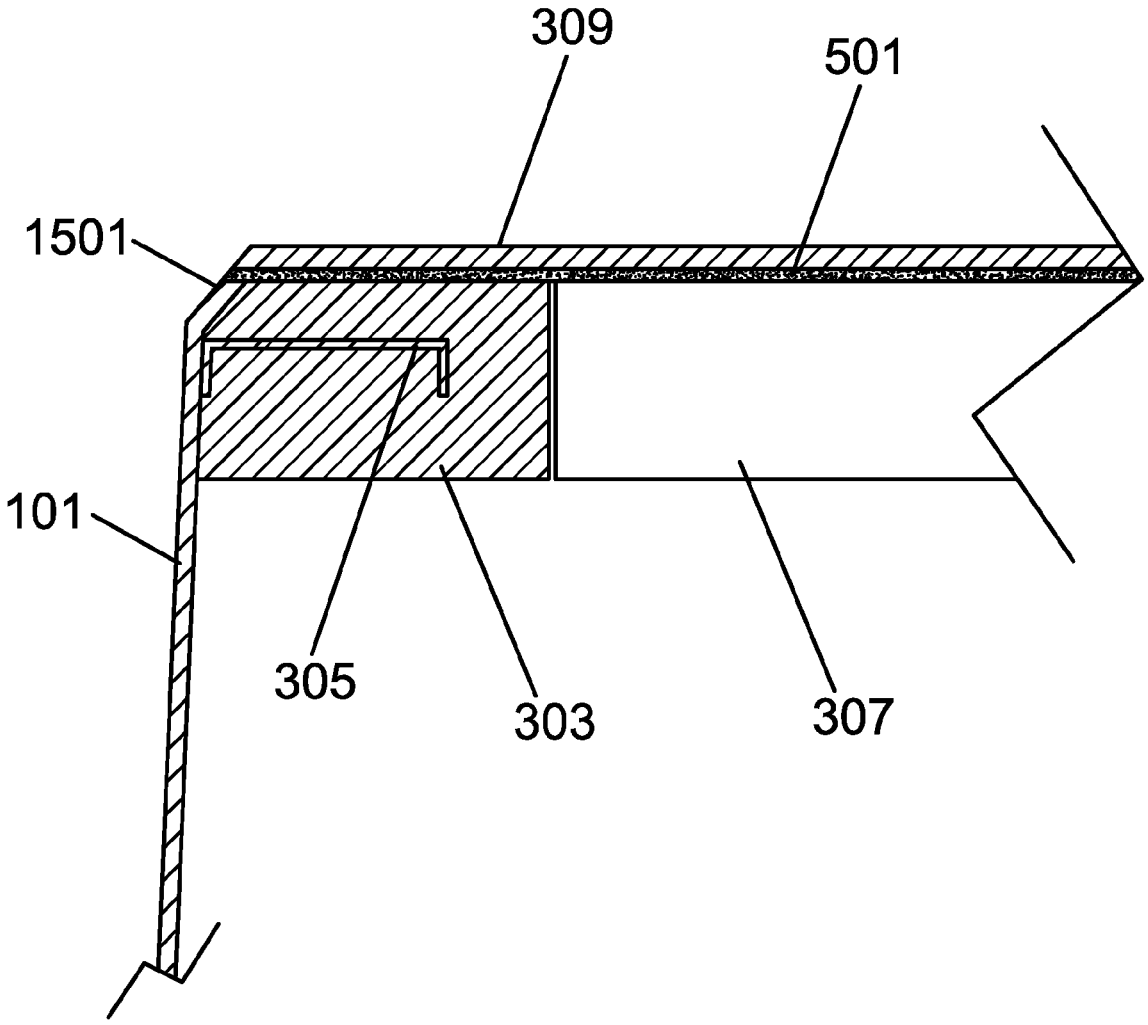
FIG. 15 is a close up sectional view of the edge detail of an alternative embodiment of the undermount sink.

Lastly, FIG. 15 depicts a close up sectional view of the edge detail of an alternative embodiment of the undermount sink. In FIG. 15, the sink bowl 101 contains a beveled, angled or decorative feature 1501 as it meets the laminate 309 or solid surface material (not shown). This feature 1501 may be made from the same material as the sink bowl 101, and may take a geometry such as that shown in FIG. 15, or may take a modified geometry that conforms to the union of the sink bowl to the countertop.

It is, therefore, apparent that there has been provided, in accordance with the various objects of the present invention, an undermount sink that can be mounted to both laminate and solid surface countertops. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An undermount sink for undermounting to a laminate countertop comprising a substrate and a laminate, the undermount sink comprising:

an undermount sink bowl;

a mounting flange continuous around and attached to the upper outer perimeter of the undermount sink bowl; and a mounting flange support within and encapsulated by the mounting flange and attached to the upper outer perimeter of the undermount sink bowl;

wherein the mounting flange is cast around the mounting flange support and the upper outer perimeter of the undermount sink bowl creating a singular and continuous piece around the upper outer perimeter of the undermount sink bowl; and the upper outer perimeter of the undermount sink bowl extends past the horizontal plane where the mounting flange support terminates on a generally vertical wall of the undermount sink bowl.

2. The undermount sink as recited in claim 1, further comprising an adhesive for bonding said mounting flange to said laminate.

3. The undermount sink as recited in claim 2, wherein said adhesive is tinted with a colorant.

4. The undermount sink as recited in claim 1, wherein said mounting flange comprises a resin.

5. The undermount sink as recited in claim 4, wherein said resin comprises an acrylic resin.

6. The undermount sink as recited in claim 1, wherein said mounting flange comprises a polymer.

7. The undermount sink as recited in claim 1, wherein said mounting flange comprises a metal.

8. An undermount sink for undermounting to a solid surface countertop, the undermount sink comprising:

an undermount sink bowl;

a mounting flange continuous around and attached to the upper outer perimeter of the undermount sink bowl; and a mounting flange support within and encapsulated by the mounting flange and attached to the upper outer perimeter of the undermount sink bowl;

wherein the mounting flange is cast around the mounting flange support and the upper outer perimeter of the undermount sink bowl creating a singular and continuous piece around the upper outer perimeter of the undermount sink bowl; and the upper outer perimeter of the undermount sink bowl extends past the horizontal plane where the mounting flange support terminates on a generally vertical wall of the undermount sink bowl.

9. The undermount sink as recited in claim 8, further comprising an adhesive for bonding said mounting flange to said solid surface countertop.

10. The undermount sink as recited in claim 9, wherein said adhesive is tinted with a colorant.

11. The undermount sink as recited in claim 8, wherein said mounting flange comprises a resin.

12. The undermount sink as recited in claim 11, wherein said resin comprises an acrylic resin.

13. The undermount sink as recited in claim 8, wherein said mounting flange comprises a polymer.

14. The undermount sink as recited in claim 8, wherein said mounting flange comprises a metal.

15. A method of forming a metal undermount sink comprising:

fabricating a metal undermount sink bowl including a wall at least partially defining a cavity within an interior of the undermount sink bowl;

fabricating a mounting flange support to at least partially surround the wall and extending outward from an exterior of the wall;

locating the mounting flange support along an exterior of a generally vertical wall and below the top edge of the generally vertical wall; and casting a mounting flange around the mounting flange support and the upper outer perimeter of the undermount sink bowl creating a singular and continuous piece around the upper outer perimeter of the undermount sink bowl.

16. The method of claim 15, wherein the act of fabricating the metal undermount sink includes stamping the metal undermount sink using a metal press and a metal sheet.

17. The method of claim 15, wherein the act of locating the mounting flange support includes mechanically fastening the mounting flange support to an exterior surface of the wall.

18. The method of claim 15, wherein the act of locating the mounting flange support includes adhering, using an adhesive, the mounting flange to an exterior surface of the wall.

19. The method of claim 15, wherein the act of forming the mounting flange includes at least partially surrounding at least a portion of the mounting flange support in a resin.

20. The method of claim 15, wherein the act of forming the mounting flange includes at least partially surrounding at least a portion of the mounting flange support in a polymer.

21. The method of claim 15, wherein:

the act of locating the mounting flange support includes welding the mounting flange to an exterior surface of the wall recessed below the top lip of the metal undermount sink; and the act of forming the mounting flange includes encasing at least a portion of the mounting flange support in at least one of a polymer and a resin.

* * * * *